US006584636B2

(12) United States Patent
Schlem

(10) Patent No.: US 6,584,636 B2
(45) Date of Patent: Jul. 1, 2003

(54) FOOTWEAR CLEANING APPARATUS

(76) Inventor: Jon E Schlem, P.O. Box 132, Sunray, TX (US) 79086-0132

( * ) Notice: Subject to any disclaimer, the term of this patent is extended or adjusted under 35 U.S.C. 154(b) by 10 days.

(21) Appl. No.: 09/849,328

(22) Filed: May 5, 2001

(65) Prior Publication Data

US 2002/0189039 A1 Dec. 19, 2002

(51) Int. Cl.[7] ..... B08B 1/00; A47L 23/06; A47L 5/38

(52) U.S. Cl. ..... 15/104.92; 15/30; 15/31; 15/32; 15/36; 15/310; 15/311; 15/21.1; 15/112; 15/111; 15/88.1

(58) Field of Search ..... 15/30–37, 310–11, 15/21.1, 112, 161, 237, 53.4, 97.1–94.3, 111, 113, 88.1, 102, 77, 177, 104.92; 134/6, 119; D32/49, 19, 14.1

(56) References Cited

U.S. PATENT DOCUMENTS 867,028 A * 9/1907 Frisch ..... 15/112
3,066,338 A * 12/1962 Nappi ..... 134/199
4,532,668 A * 8/1985 Slonicki ..... 15/104.92
D355,734 S * 2/1995 Goble ..... 15/161

* cited by examiner

*Primary Examiner*—Robert J. Warden, Sr..
*Assistant Examiner*—Shay L Balsis
(74) *Attorney, Agent, or Firm*—Michael I. Kroll

(57) ABSTRACT

A footwear cleaning apparatus includes a vertically oriented frame with an upper frame for supporting the user that is standing while cleaning the footwear. The apparatus receives water from a garden hose and provides a control valve for regulating the water flow while the user is standing upright. The water is directed upwardly through a foot platform on the lower frame, and also through a lower brush onto the footwear sole, the resulting splash causing water to wet two side brushes that are oriented to bear upon the sides of the footwear. A scraper assembly is also on the lower frame and provides a horizontal scraping edge and two vertical scraping edges for the sole and sides of the footwear, respectively. After the water is turned off a drain outlet allows the device to be drained.

21 Claims, 7 Drawing Sheets

FOOTWEAR CLEANING APPARATUS

BACKGROUND OF THE INVENTION

1. Field of the Invention

The present invention relates generally to footwear cleaning equipment.

2. Description of the Prior Art

There are other shoe and boot cleaning devices designed to improve the cleaning of foot wear. Typical of these is U.S. Pat. No. 640,920 issued to Kratofil et al on Jan. 9, 1900.

Another patent was issued to Zrnel on Nov. 3, 1931 as U.S. Pat. No. 1,830,455. Yet another U.S. Pat. No. 3,094,727 was issued to Osteen on June 25, 1963 and still yet another was issued on Aug. 13, 1963 to Williams as U.S. Pat. No. 3,100,312.

Another patent was issued to Fresh on Feb. 16, 1988 as U.S. Pat. No. 4,724,564. Another patent was issued to Burns on Apr. 24, 1990 as U.S. Pat. No. 4,918,779. Another patent was issued to Burey et al. on Jun. 25, 1991 as U.S. Pat. No. 5,025,528. Another patent was issued to Willner on Nov. 24, 1998 as U.S. Pat. No. 5,839,144. Another patent was issued to Openshaw et al. on Sep. 14, 1999 as U.S. Pat. No. 5,950,269.

U.S. Pat. No. 640,920

Inventor: Johann Kratofil et al.

Issued: Jan. 9, 1900

A shoe-cleaning machine is provided having a casing, of oppositely-sliding side brushes therein, a driven shaft having cranks connected with said side brushes, and a toe brush mounted on said shaft; of a heel brush, a counter shaft, belts connecting the counter shaft with the heel brush and with the driven shaft, and a power shaft for rotating the driven shaft.

U.S. Pat. No. 1,830,455

Inventor: John Zrnel

Issued: Nov. 3, 1931

A shoe cleaner is provided having a frame including a plurality of scraper bars and having front and back bars extending downwardly at their opposite ends to form feet, brushes having backs secured between the feet at each side of the frame with the lower faces of the back lying in the same plane as the lower ends of the feet and having bristles extending slightly above the frame, said frame also having side bars at the inner ends of said feet, the bristles at the inner sides of the brushes bearing against said side bars, bristle supporting angles fixed to the brush backs at their outer sides and bearing against the bristles at said sides, and brace bars connecting said scraper bars and having their upper edges of the scraper bars and their lower edges in the plane of the lower edges of the feet to provide an intermediate support for the scraper bars.

U.S. Pat. No. 3,094,727

Inventor: Emmett H. Osteen

Issued: Jun. 25, 1963

A cleaning device is provided comprising a rotatably mounted support member, a pair of motor driven brush assemblies, each having a circular shape, rotatably and coaxially fixed in axially spaced relation on said support member, said brush assemblies each including a sleeve having a flexible cleaning surface on its outer periphery, first and second cleaning disks larger in diameter than said sleeve, said first and second discs each having a flexible cleaning surface opposing one another and overlapping said first mentioned surface so as to form an annular groove adapted to receive and clean a piece of footwear, said first surface comprising a multitude of radially extending bristles and said other surfaces comprising a multitude of axially extending bristles, said device further comprising a fixed cleaning plate extending into and across said groove in positive rubbing contact with the outer ends of said bristles, a scraper plate fixed to said device so as to have a scraping edge generally parallel to and of the same elevation as said first mentioned flexible cleaning surface, said scraper plate extending substantially the full length of said support thus providing a scraping edge between the axially spaced brush assemblies so as to allow said piece of footwear to be scraped without interference from said brush assemblies while still maintaining the same relative position in relation to said device.

U.S. Pat. No. 3,100,312

Inventor: W. H. Williams

Issued: Aug. 13, 1963

A cleat cleaner is provided comprising a mat having an upper and lower surface, a plurality of projections fixed to said upper surface, each projection having a central axis, a top in a plane remote from said mat and a bottom adjacent the upper surface of said mat, said projections being spaced on said mat in staggered relationship to each other, the central axis of each projection being perpendicular to said mat and each of said projections having a plurality of outwardly directed flexible vane members evenly spaced around said central axis.

U.S. Pat. No. 4,724,564

Inventor: Elwyn M. Fresh

Issued: Feb. 16, 1988

A shoe cleaning apparatus for household use includes a horizontal rotary brush to clean a toe portion of the sole of a shoe, a reciprocating brush to clean a heel portion of the shoe, and a vertical oscillating brush to clean side portions of the shoe. All the brushes are driven by a single motor which, along with the brushes, is mounted in a housing. A shoe rest bar extends across the housing between the rotary brush and the reciprocating brush. A user of the apparatus places an instep of the shoe on his foot on the shoe rest bar and pivots about the bar to vary the degree of engagement between portions of the shoe and the rotary and reciprocating brushes. The rotary brush includes baffles which cooperate with the rotary brush to create an airflow to carry away material removed from the shoe to a filter bag.

U.S. Pat. No. 4,918,779

Inventor: Matt B. Burns

Issued: Apr. 24, 1990

Disclosed is an improved foot spraying and cleaning device which includes a pair of opposed facing brushes, each of which has embedded therein an elongated bar having a plurality of fluid outlets therein, with the outlets of the respective bars facing one another. Flow of fluid through the bars is controlled by a foot-actuated valve mechanism. Aesthetic housings may be provided for the brushes which may be made to resemble shells.

U.S. Pat. No. 5,025,528

Inventor: Bernard P. Burey et al.

Issued: Jun. 25, 1991

An apparatus for brushing and/or cleaning shoes and other footwear which includes a number of sequential stations. The apparatus includes a machine having a plurality of upstanding brushes mounted for rotation about respective generally vertical axes. The vertical axes of the upstanding brushes are sequentially spaced apart and each of the brushing stations is defined by a sequential pair of the upstanding brushes. Between sequential pairs of the upstanding brushes, a respective flat circular brush is mounted. Each of the brushes is driven by a single motor. Further, a casing is provided for housing the brushes and at least a portion of the driving transmission from the motor. The casing has a lateral opening at each of the brushing stations for introducing a shoe or boot for brushing or cleaning. A cleaning fluid for the brushing and/or cleaning stations can be merely water or water with an additive such as a detergent or disinfectant. In addition, heated air can be provided for drying the cleaned shoes.

U.S. Pat. No. 5,839,144

Inventor: Byron J. Willner

Issued: Nov. 24, 1998

An automatic boot cleaning apparatus is provided. The apparatus has at least three brushes and a scraper. The brushes are positioned to apply scrubbing force to the underside of the sole of a boot or shoe, as well as the sides of the boot or shoe. The scraper is positioned behind the brushes and may be used to remove the excess mud or dirt from the boot or shoe. The apparatus is preferably powered by an AC motor which is connected to a source of AC power. The brushes may be rotated continuously in one direction, or oscillated thereby increasing the effectiveness of the cleaning operation. In an alternative embodiment, the device is connected to a source of fluid pressure and has a plurality of fluid outlet nozzles secured to the scraper. The nozzles are arranged to spray fluid directly onto the brushes and thus are capable of effecting a self cleaning operation. The entire housing, including the activation switch, is sealed against environmental effects allowing for outdoor use.

U.S. Pat. No. 5,950,269

Inventor: D. E. Openshaw et al.

Issued: Sep. 14, 1999

A sole cleaning device for cleaning the bottoms and sides of the soles of boots and shoes including a rotating brush mounted above a container of water so that upon rotation of the brush a portion of the brush extends into the water. The device further includes a removable scraper grate for supporting a show above the water but in engagement with the brush. A motor for rotating the brush against the sole of the boot is provided. The removable grate provided with a pair of spaced and parallel side rails having fixed brushes mounted to the side rails having fixed brushes mounted to the side rails and facing one another. The removable grate further includes a sieve platform extending on one side of the grate above the water. Sponges are positioned on top of the sieve for removing water from a boot or shoe placed on the sponge.

SUMMARY OF THE PRESENT INVENTION

A primary object of the present invention is to provide a new and improved boot and shoe cleaning apparatus.

Another object of the present invention is to provide an improved shoe and boot cleaning apparatus which is suitable for outdoor use and storage.

Yet another object of the present invention is to provide an improved shoe and boot cleaning apparatus having a plurality of brushes pointing or facing in three different directions.

Still yet another object of the present invention is to provide an improved shoe and boot cleaning apparatus including a water injected system.

Another object of the present invention is to provide a water injection system that may be controlled by the user by means of a control valve.

Yet another object of the present invention is to provide a shoe and boot cleaning apparatus with scrapers that may remove clumps of dirt and mud prior to using the brushes and water injection.

Still yet another object of the present invention is to provide a shoe and boot apparatus that may be easily stored away when not in use.

Additional objects of the present invention will appear as the description proceeds.

The present invention overcomes the shortcomings of the prior art by providing a new and improved boot and shoe cleaning apparatus. The device is suitable for outdoor use and storage. The device has a plurality of brushes engaging the footwear on three sides, and also has a fluid delivery system whereby a selective amount of water can be projected onto the base of the footwear. The device also has a scraper element positioned adjacent the brush elements. The scraper and brush elements are contained within a tubular or bar stock frame which extends in a vertical plane to a point whereby the upper frame member can serve as a user support element, supporting the user while cleaning the footwear. Located on the upper frame is a threaded element whereby a fluid source can be attached thereto. Also, having a flow control valve is available for selectively controlling the amount of fluid being delivered to the footwear cleaning element, while standing upright using the device.

Extending downwardly on the frame is a conduit being in fluid communication with the fluid source and extending into the sole brush element. The lower cross member of the frame has a scraper adjacent the plurality of brushes. The brushes are positioned to engage the sole and sides of the footwear. Each of the brushes on the opposing sides are positioned within sleeves to prevent movement. The lower brush element has a centrally disposed aperture wherethrough an amount of fluid can be selectively applied to the sole of the footwear. Also, the conduit extending from the fluid source has a valve whereby the conduit can be drained of any residual fluid after the fluid source has been shut off.

A footwear cleaning apparatus is provided using a fluid from a fluid source, the apparatus comprising: a frame; a brush assembly positioned on the frame having: a generally horizontal foot platform, the foot platform having an aperture; a lower brush having bristles, the lower brush supported by the foot platform such that the lower bristles extend upwardly, the lower brush having an aperture at least partially aligned with the foot platform aperture; a first and second side brush, each having bristles; and a pair of sleeves supported by the frame, each sleeve holding one of the side brushes such that the first and second side brush bristles extend inwardly; and a fluid delivery assembly having: a fluid reception member for receiving fluid from the fluid source; a control valve in fluid communication with the fluid reception member, the control valve being positioned in an elevated position on the frame for hand manipulation by the user while standing upright, the control valve controlling the amount of fluid flow; a fluid conduit in fluid communication with the control valve; and a fluid conduit reception member for receiving fluid from the fluid conduit and discharging the fluid through the foot platform aperture and the lower brush aperture, such that the footwear adjacent the lower brush aperture is wetted.

In another embodiment, the frame is sized for grasping by the user while the user is standing in an upright position.

In another embodiment, a footwear cleaning apparatus using a fluid from a fluid source, is provided, the apparatus comprising: a frame having: at least two generally vertical frame members; a base supporting the two vertical frame members; a lower cross member positioned between the two vertical frame members; and an upper cross member positioned between the two vertical frame members; a brush assembly having: a generally horizontal foot platform supported by the lower cross member, the foot platform having an aperture; a lower brush having bristles, the lower brush supported by the foot platform such that the lower bristles extend upwardly, the lower brush having an aperture at least partially aligned with the foot platform aperture; a first and second side brush, each having bristles; and a pair of sleeves supported by the frame, each sleeve holding one of the side brushes such that the first and second side brush bristles extend inwardly; and a fluid delivery assembly having: a fluid reception member for receiving fluid from the fluid source; a control valve in fluid communication with the fluid reception member, the control valve being positioned in an elevated position on the frame, the control valve controlling the amount of fluid flow; a fluid conduit in fluid communication with the control valve; and a fluid conduit reception member for receiving fluid from the fluid conduit and discharging the fluid through the foot platform aperture and the lower brush aperture, such that the footwear adjacent the lower brush aperture is wetted.

In another embodiment, the fluid source is a hose.

In another embodiment, the fluid source is a water hose.

In another embodiment, the control valve includes an off position terminating the fluid flow.

In another embodiment, the control valve includes a variable fluid flow control for varying the amount of fluid flow.

In another embodiment, the foot panel has a recess about the aperture such that fluid in the recess drains through the aperture.

In another embodiment, the fluid conduit reception member further comprises a drain outlet, such that the fluid draining from the foot panel through the foot panel aperture is drained from the fluid conduit reception member.

In another embodiment, the fluid conduit reception member is a tee, the tee having a branch for draining, such that the fluid draining from the foot panel through the foot panel aperture is drained from the fluid conduit reception member through said branch.

In another embodiment, the frame base further comprises a first portion for the first vertical frame member and a second portion for the second vertical frame member.

In another embodiment, the control valve is attached to the frame upper cross member.

In another embodiment, the control valve is attached to one of the frame vertical members.

In another embodiment, the control valve is attached proximate the frame upper cross member.

In another embodiment, the first and second side brush bristles are less than or equal to four inches apart.

In another embodiment, the frame further comprises a scraper assembly supported by the frame lower cross member.

In another embodiment, the frame upper cross member is positioned for grasping by the user while standing in an upright position.

In another embodiment, the frame further comprises a scraper assembly supported by the frame lower cross member, the scraper assembly having a scraper member, the scraper member having an upwardly disposed edge.

In another embodiment, the scraper assembly further comprises a pair of generally vertical scraper members, each vertical scraper member having a scraper edge, each scraper edge being disposed sidewardly and inwardly.

In another embodiment, one of the sleeves is supported by one of the frame vertical members, and the other sleeve is supported by one of the vertical scraper members.

In another embodiment, a footwear cleaning apparatus using a fluid from a fluid source is provided, the apparatus comprising: a frame, the frame having means for the user to grasp the frame for support; means for aligning a lower brush adjacent the sole, and left and right side brushes adjacent the left side and right side of the footwear, said means being positioned on the frame; and means for wetting the lower brush such that the sole is wetted, said means having means for the user to control the fluid flow while standing in an upright position.

In another embodiment, the apparatus further comprises means for draining the fluid from the means for wetting the brush.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claim.

BRIEF DESCRIPTION OF THE DRAWING FIGURES

Figure 6:
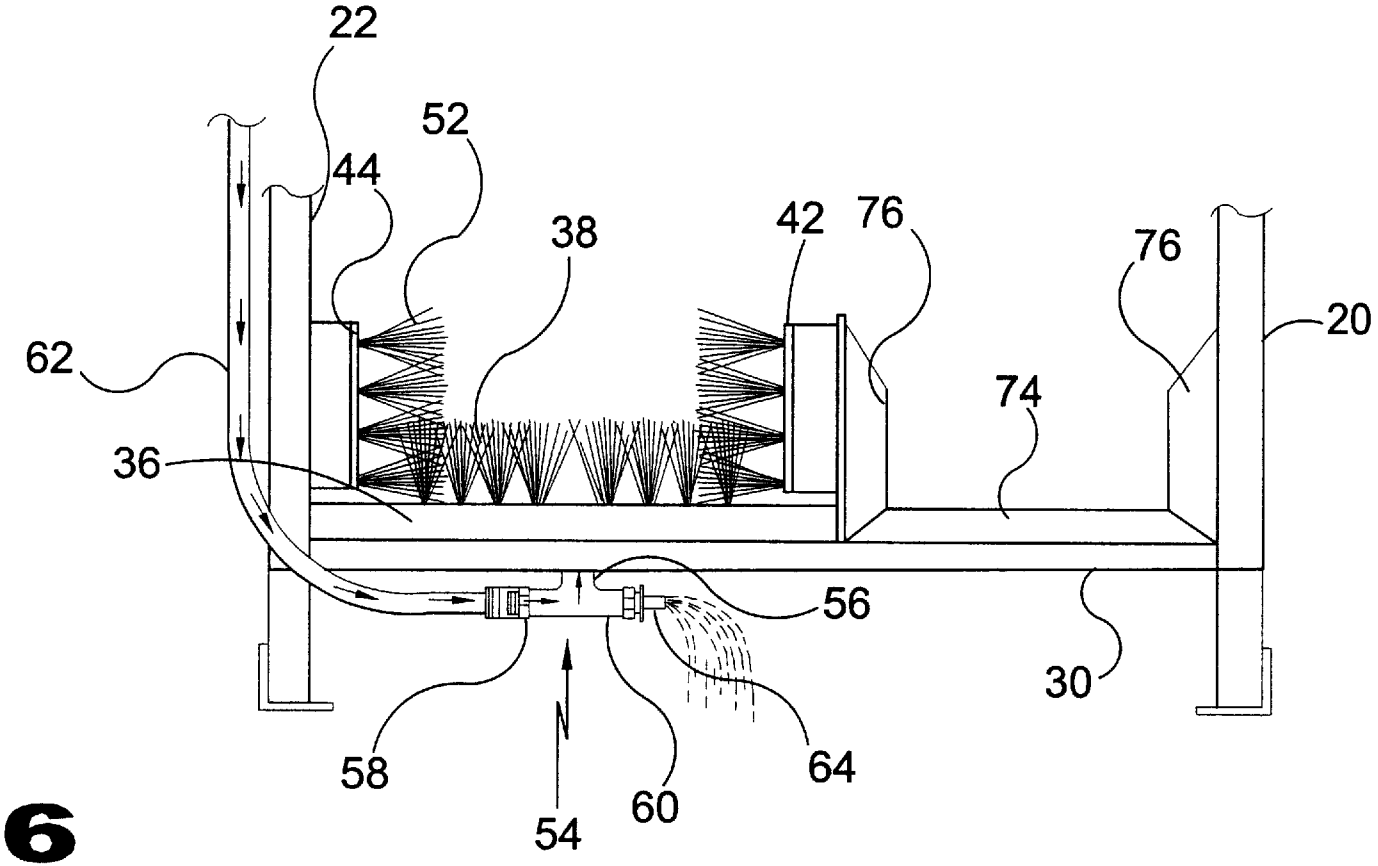

FIG. 6 is a partial front view of the present invention. When the cleaning procedure is complete, the residual water may be drained by opening the drain valve. The water is shown in arrows and spray.

Figure 7:
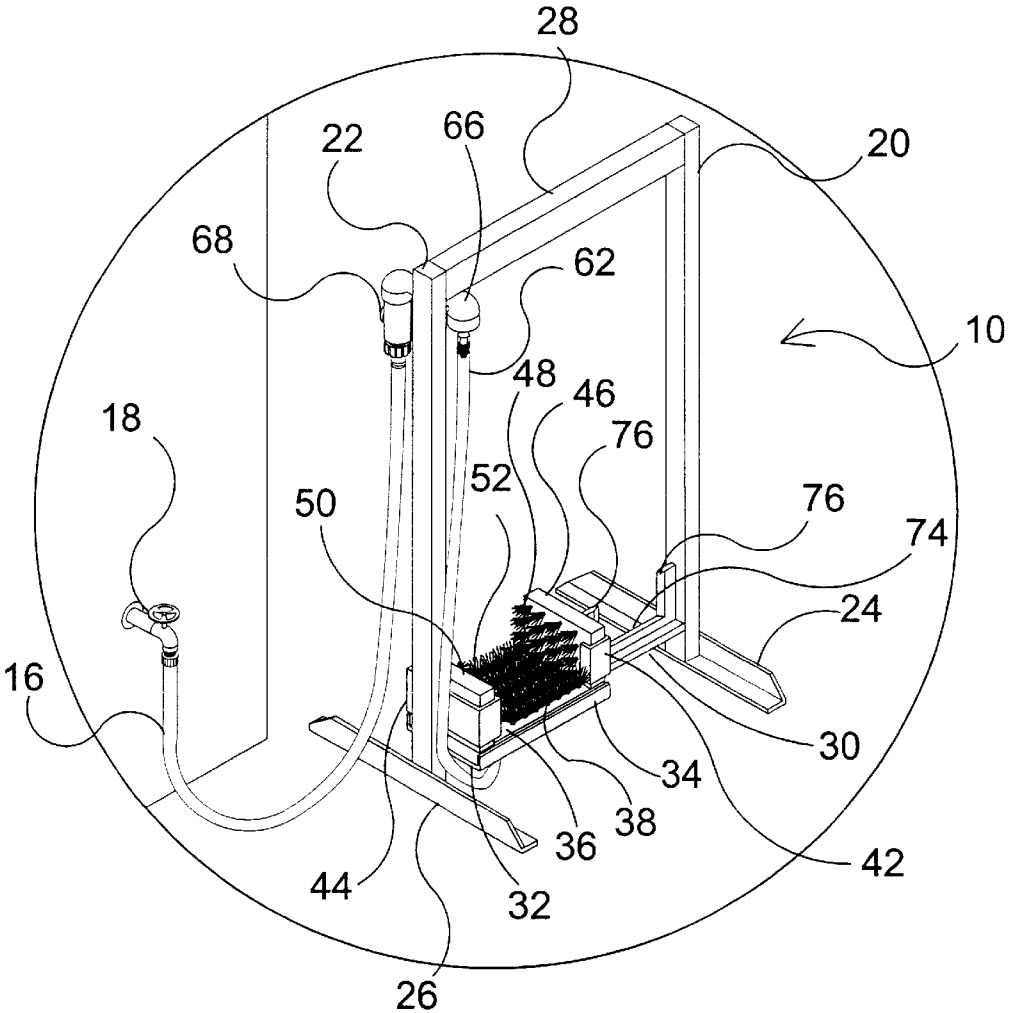

FIG. 7 is an isometric view of the present invention.

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1–7 illustrate the Footwear Cleaning Apparatus of the present invention indicated generally by the numeral 10.

Figure 1:
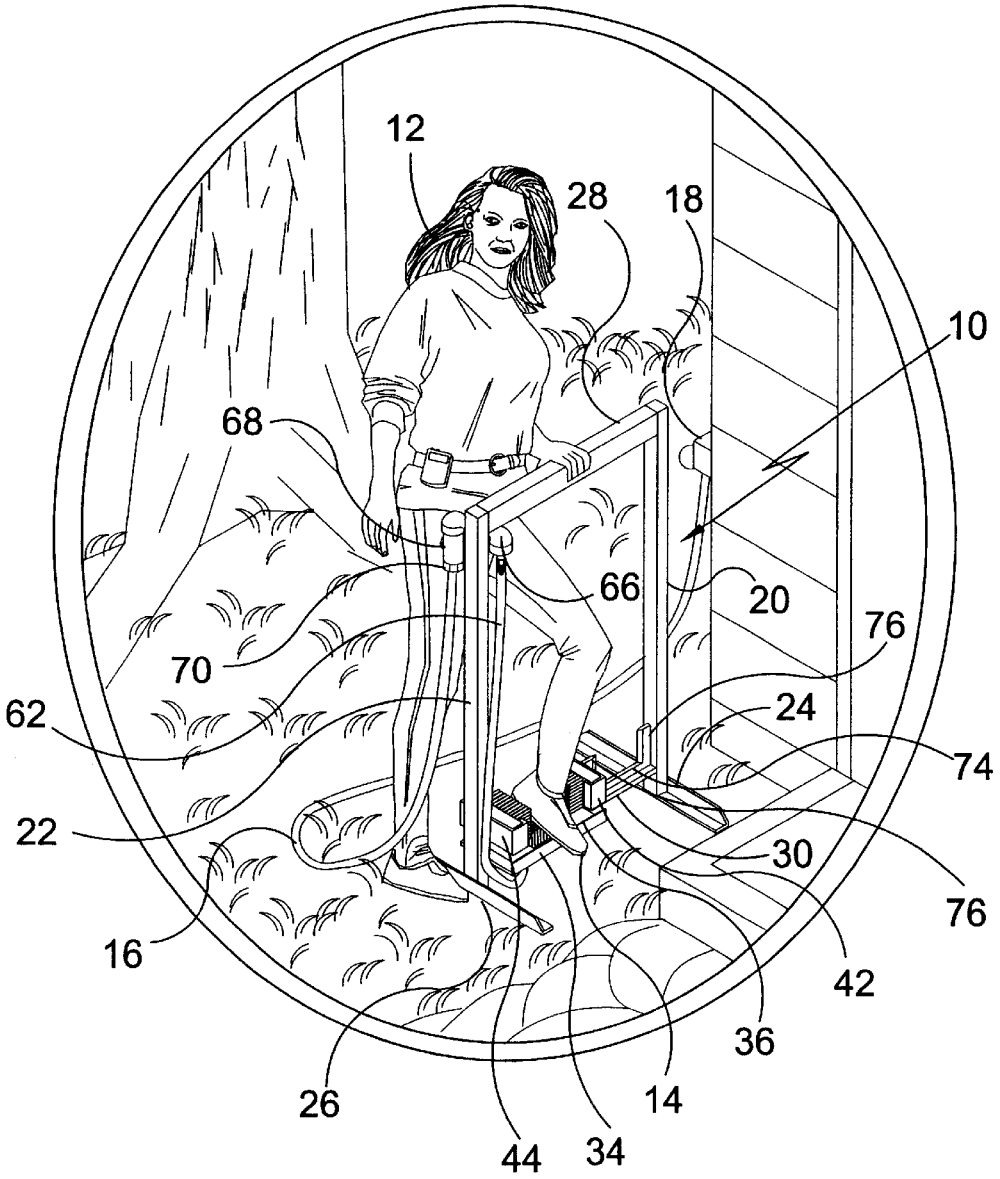
FIG. 1 is a perspective view of the present invention showing the present invention being used by a woman to clean her shoes, and also showing the use of the handrail to keep balance. The device is connected to a standard water hose to supply the cleaning brushes with water.

The apparatus 10 is shown generally in FIGS. 1–7 and in use in FIG. 1, by user 12, wearing typical shoes 14, and using a typical water hose 16 as the fluid source.

The apparatus 10 has generally vertical left and right frame members 20,22, the left frame member 20 supported by a generally horizontal left base member 24, the right frame member 22 supported by a generally horizontal right base member 26.

An upper cross member 28 extends between the left and right frame members 20,22, and is positioned such that the user 12 may grasp the upper cross member 28 while standing upright.

A lower cross member 30 extends between the left and right frame members 20,22 providing support for a foot platform 32 that has side members 34 for receiving and positioning a lower brush 36 with the lower brush bristles 38 extending upwardly. The lower brush 36 has a centrally disposed aperture 40 that is aligned with aperture 41 in the foot platform 32. In the preferred embodiment, the lower cross member 30 also has an aligned aperture, as shown on FIG. 5.

A left sleeve 42 and a right sleeve 44 receive and position a left side brush 46, with bristles 48 facing sideways and inwardly, and a right side brush 50, with bristles 52 facing sideways and inwardly. The installed brushes 36,46,50 are shown in FIGS. 3 and 5–7. The left and right side brushes 46,50 are spaced at varying distances, and can be spaced such that the typical shoe 14 will simultaneously encounter left and right side brush bristles 48,52 when the shoe 14 is inserted between the same.

Figure 5:
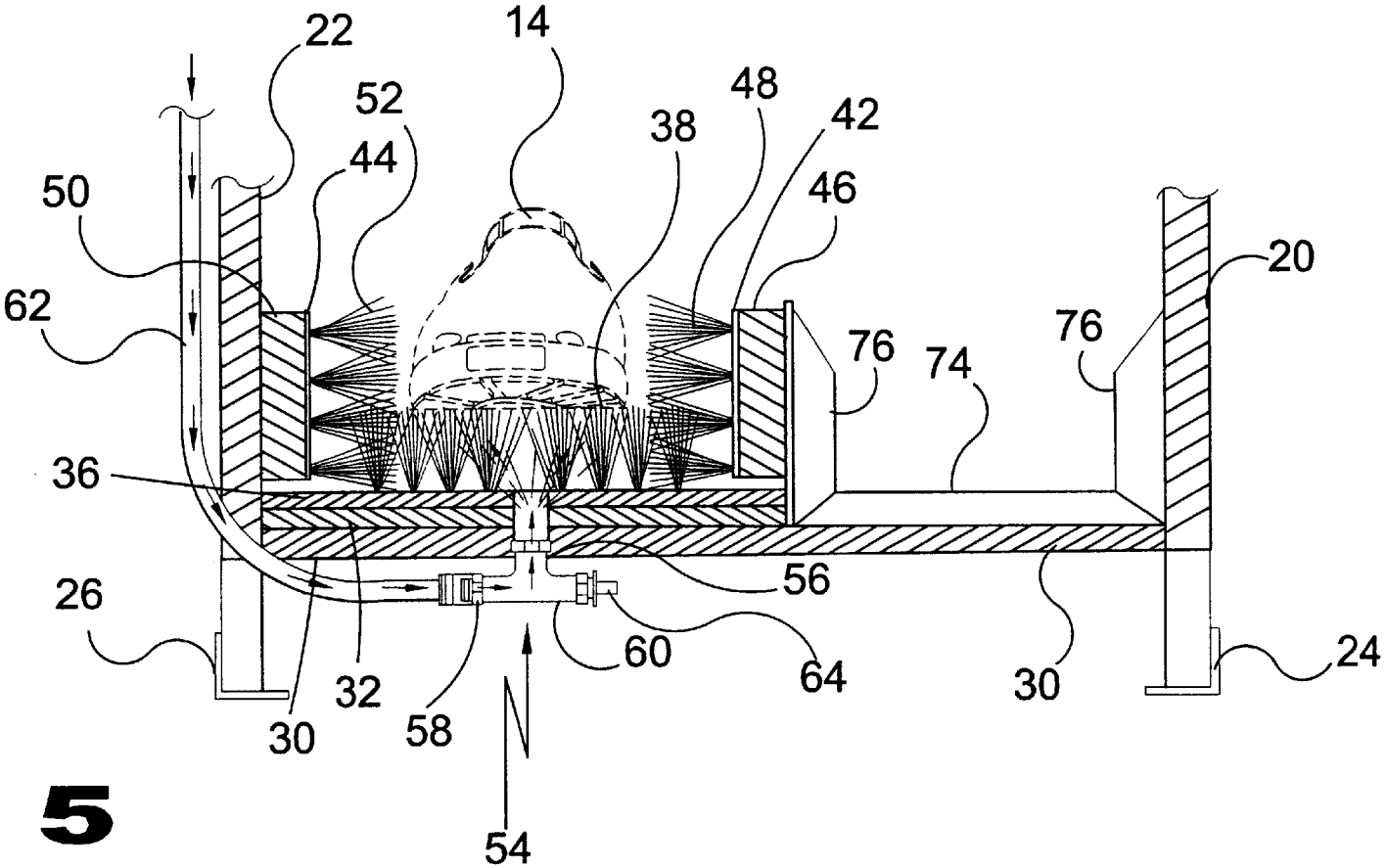
FIG. 5 is a partial sectional front view of the present invention. Water from the hose (shown as arrows and spray) is sent to the tee and into the lower brush to wash and rinse mud and dirt from soiled footwear.

As shown in FIGS. 5–6, a tee fining 54 is positioned such that a vertical branch 56 is directed to the aligned apertures 40,41. The tee 54 has first and second horizontal branches 58,60, the first horizontal branch 58 being adapted to couple with hose member 62, the second horizontal branch 60 being adapted for opening to the atmosphere when desired by manipulation of valve 64.

Figure 2:
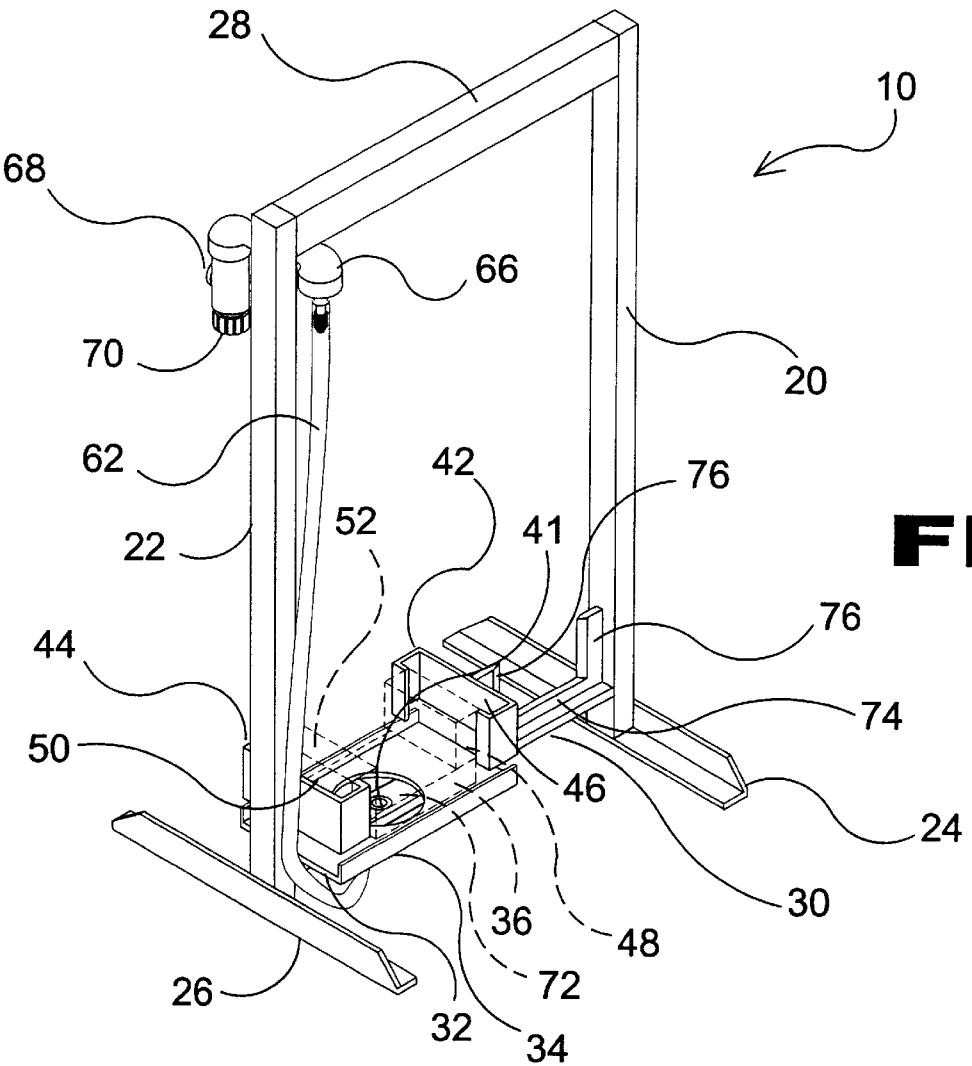
FIG. 2 is an isometric view of the present invention showing a means to bring water into the device and to the water outlet positioned on the foot platform. Also a foot scraper is shown placed next to the brush restraints for easy transition between the foot platform and the scraper.
Figure 3:
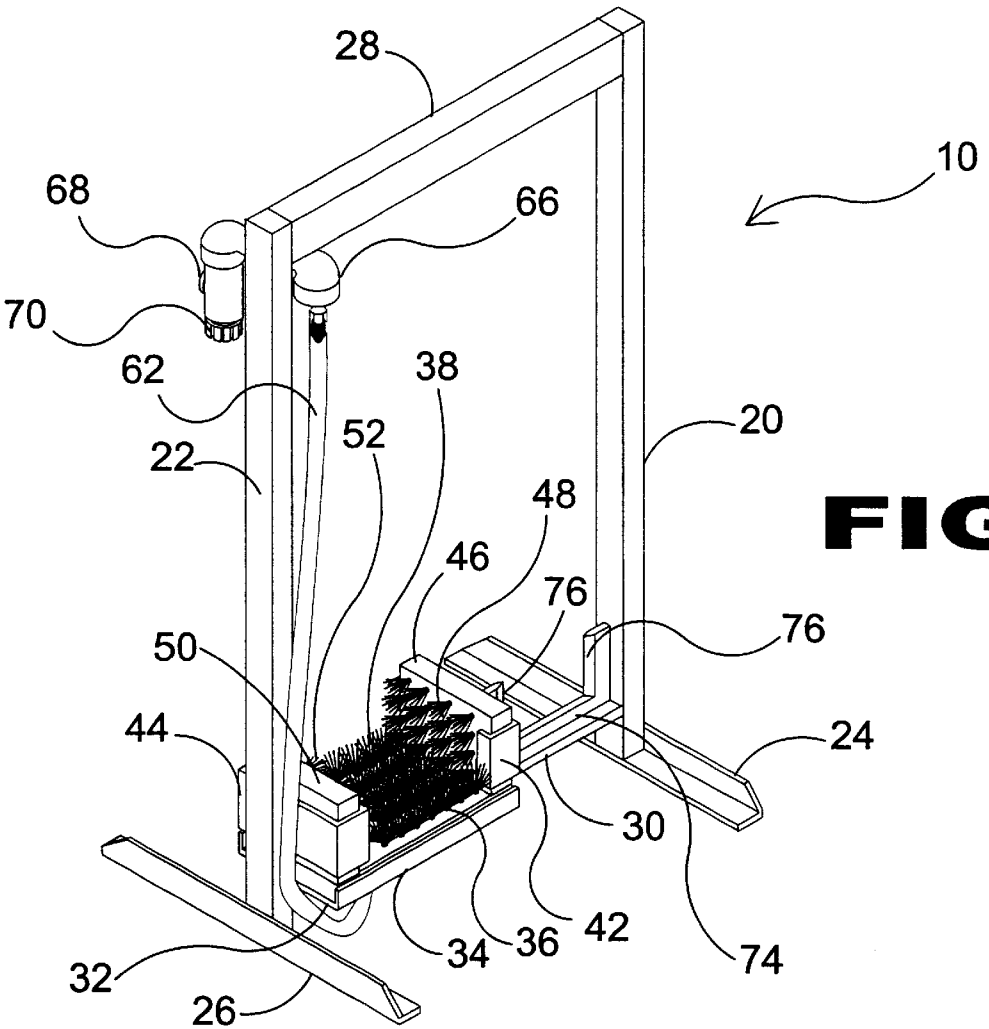
FIG. 3 is an isometric view of the present invention, showing the arrangement of the cleaning brushes, with the two side brushes having brush restraints to secure them in place, the two side brushes holding the bottom brush in place.

As shown in FIG. 2, the hose member 62 is drawn along the right frame member 22 for coupling with a connection member 66 to establish fluid communication with a control valve 68, that in turn utilizes a second connection member 70 to establish fluid communication with the water hose 16. The control valve 68 is hand-operable and is attached high on the apparatus for ready access and manipulation by the user 12 while the user 12 is standing in an upright position with his or her shoe 14 positioned for scrubbing by the brushes 36,46,50.

A recess 72 in the foot platform 32 assists in directing accumulated water into the apertures 40,41 for gravity drainage into the tee fitting upward branch 56 and out the second horizontal branch 60, upon opening the valve 64.

Figure 4:
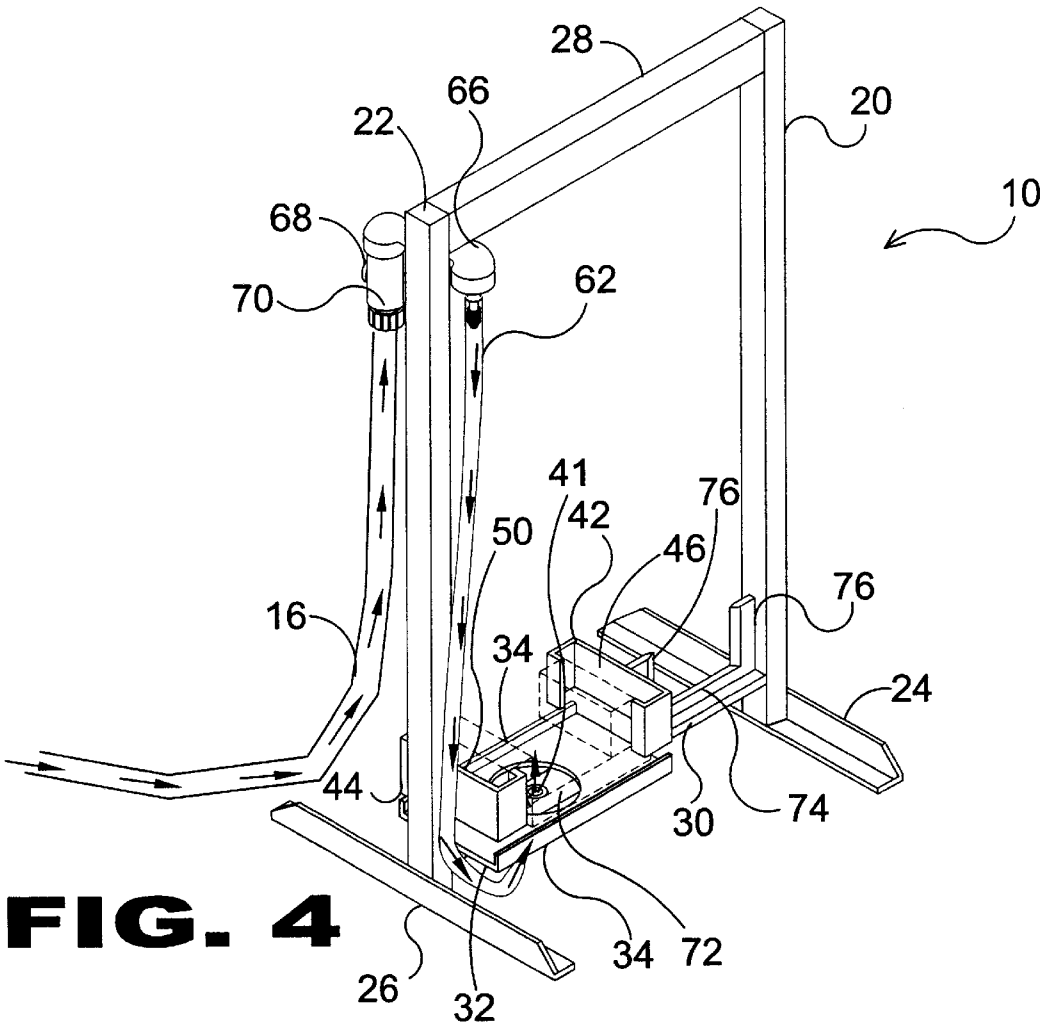
FIG. 4 is an isometric view of the present invention, showing a means to bring water into the device and to the water outlet positioned on the foot platform.

To utilize the apparatus 10, the user 12 turns on the water spigot 18 to provide a continuous flow into the water hose 16. The user 12 then sets the control valve 68 as necessary to achieve the desired flow rate of the water. As shown in FIG. 4, water is drawn from the water hose 16, through the control valve 68, through hose member 62, into the tee fitting first horizontal branch 58, and out through the tee fitting upward branch 56. Upon leaving the tee fitting upward branch 56 the water passes through the apertures 40,41 onto the sole of the shoe 14. Depending upon the fluid flow rate chosen, the water will undergo a varied amount of splashing, and can effectively wet the side brushes 46,50 as well as the lower brush 36 if the discharge through the apertures 40,41 is sufficiently strong.

If the dirt or mud on the shoe 14 is excessive, the user 12 can first scrape larger accumulations from the shoe 14 on a scraper assembly lower edge 74, or one of the scraper assembly side edges 76. The left sleeve 42 is attached to the right scraper assembly edge 76, while the right sleeve 44 is attached to the right vertical frame member 22.

While manipulating the shoe 14 being cleaned, the user 12 is supported by grasping the frame upper cross member 28. As the process nears completion and less water is needed, the user 12 can decrease or terminate the fluid flow by manipulating the control valve 68. Because the control valve 68 is elevated, the user 12 can manipulate the valve 68 while standing upright and while continuing to clean the shoe 14.

The device 10 and its foregoing components can be constructed using various materials, including various metals, woods, and plastics for the frame and base members 20,22,24,26,28,30, foot platform 32, and brushes 36,46,50. The hose member 62, fittings 54, 66, 68,70. The materials, in various component combinations, can be sized to accommodate users 12 and shoes 14 of various sizes, all in accordance with the present invention, and as determined by the intended end use for the overall device.

With respect to the above description then, it is to be realized that the optimum material and dimensional relationships for the parts of the apparatus 10, to include variations in size, materials, shape, and form, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A footwear cleaning apparatus using a fluid from a fluid source, the apparatus comprising:

a frame;

a brush assembly positioned on the frame having:

a generally horizontal foot platform, the foot platform having an aperture;

a lower brush having bristles, the lower brush supported by the foot platform such that the lower bristles extend upwardly, the lower brush having an aperture at least partially aligned with the foot platform aperture;

a first and second side brush, each having bristles; and a pair of sleeves supported by the frame, each sleeve holding one of the side brushes such that the first and second side brush bristles extend inwardly; and a fluid delivery assembly having:

a fluid reception member for receiving fluid from the fluid source;

a control valve in fluid communication with the fluid reception member, the control valve being positioned in an elevated position on the frame for hand manipulation by a user while standing upright, the control valve controlling the amount of fluid flow;

a fluid conduit in fluid communication with the control valve; and a fluid conduit reception member for receiving fluid from the fluid conduit and discharging the fluid through the foot platform aperture and the lower brush aperture, such that the footwear adjacent the lower brush aperture is wetted.

2. The apparatus of claim 1, wherein the frame is sized for grasping by the user while the user is standing in an upright position.

3. A footwear cleaning apparatus using a fluid from a fluid source, the apparatus comprising:

a frame having:

at least two generally vertical frame members;

a base supporting the two vertical frame members;

a lower cross member positioned between the two vertical frame members; and an upper cross member positioned between the two vertical frame members;

a brush assembly having:

a generally horizontal foot platform supported by the lower cross member, the foot platform having an aperture;

a lower brush having bristles, the lower brush supported by the foot platform such that the lower bristles extend upwardly, the lower brush having an aperture at least partially aligned with the foot platform aperture;

a first and second side brush, each having bristles; and a pair of sleeves supported by the frame, each sleeve holding one of the side brushes such that the first and second side brush bristles extend inwardly; and a fluid delivery assembly having:

a fluid reception member for receiving fluid from the fluid source;

a control valve in fluid communication with the fluid reception member, the control valve being positioned in an elevated position on the frame, the control valve controlling the amount of fluid flow;

a fluid conduit in fluid communication with the control valve; and a fluid conduit reception member for receiving fluid from the fluid conduit and discharging the fluid through the foot platform aperture and the lower brush aperture, such that the footwear adjacent the lower brush aperture is wetted.

4. The apparatus of claim 3, wherein the fluid source is a hose.

5. The apparatus of claim 3, wherein the fluid source is a water hose.

6. The apparatus of claim 3, wherein the control valve includes an off position terminating the fluid flow.

7. The apparatus of claim 3, wherein the control valve includes a variable fluid flow control for varying the amount of fluid flow.

8. The apparatus of claim 3, wherein the foot platform has a recess about the aperture such that fluid in the recess drains through the aperture.

9. The apparatus of claim 3, wherein the fluid conduit reception member further comprises a drain outlet, such that the fluid draining from the foot platform through the foot panel aperture is drained from the fluid conduit reception member.

10. The apparatus of claim 3, wherein the fluid conduit reception member is a tee, the tee having a branch for draining, such that the fluid draining from the foot panel through the foot platform aperture is drained from the fluid conduit reception member through said branch.

11. The apparatus of claim 3, wherein the frame base further comprises a first portion for the first vertical frame member and a second portion for the second vertical frame member.

12. The apparatus of claim 3, wherein the control valve is attached to the frame upper cross member.

13. The apparatus of claim 3, wherein the control valve is attached to one of the frame vertical members.

14. The apparatus of claim 3, wherein the control valve is attached proximate the frame upper cross member.

15. The apparatus of claim 3, wherein the first and second side brush bristles are no further than four inches apart.

16. The apparatus of claim 3, wherein the frame further comprises a scraper assembly supported by the frame lower cross member.

17. The apparatus of claim 3, wherein the frame upper cross member is positioned for grasping by the user while standing in an upright position.

18. The apparatus of claim 3, wherein the frame further comprises a scraper assembly supported by the frame lower cross member, the scraper assembly having a scraper member, the scraper member having an upwardly disposed edge.

19. The apparatus of claim 18, wherein the scraper assembly further comprises a pair of generally vertical scraper members, each vertical scraper member having a scraper edge, each scraper edge being disposed sidewardly and inwardly.

20. The apparatus of claim 19, wherein the one of the sleeves is supported by one of the frame vertical members, and the other sleeve is supported by one of the vertical scraper members.

21. The apparatus of claim 20, wherein the apparatus further comprises means for draining the fluid from the means for wetting the brush.

* * * * *